US009132050B1

(12) United States Patent
Hector, Jr.

(10) Patent No.: US 9,132,050 B1
(45) Date of Patent: Sep. 15, 2015

(54) PROTECTIVE CUSHION FOR A WHEELCHAIR FOOT REST AND METHOD OF PROVIDING

(71) Applicant: Melvin G Hector, Jr., Tucson, AZ (US)

(72) Inventor: Melvin G Hector, Jr., Tucson, AZ (US)

( * ) Notice: Subject to any disclaimer, the term of this patent is extended or adjusted under 35 U.S.C. 154(b) by 0 days.

(21) Appl. No.: 14/489,325

(22) Filed: Sep. 17, 2014

(51) Int. Cl.
*A61G 5/12* (2006.01)
*A61G 5/10* (2006.01)

(52) U.S. Cl.
CPC ..... *A61G 5/1043* (2013.01); *A61G 2005/127* (2013.01)

(58) Field of Classification Search
CPC ..... A61G 5/1043; A61G 2005/127
See application file for complete search history.

(56) References Cited

U.S. PATENT DOCUMENTS

| | | | | |
|---|---|---|---|---|
| 4,192,546 | A * | 3/1980 | Smith | 297/466 |
| 4,593,929 | A * | 6/1986 | Williams | 280/650 |
| 5,906,415 | A * | 5/1999 | Mocur | 297/423.3 |
| 8,882,129 | B2 * | 11/2014 | Nault et al. | 280/304.1 |
| 2007/0057561 | A1 * | 3/2007 | Liao | 297/423.19 |

* cited by examiner

*Primary Examiner* — Kevin Hurley

(57) ABSTRACT

A new and useful protective cushion for a foot rest bracket of a wheelchair and to a new and useful method of providing the protective cushion to a foot rest bracket of a wheelchair. A substantially monolithic, nonmalleable, resilient body is provided that has a substantially closed C shape, a relatively soft, cushion like texture and a thickness that is slightly greater than a foot rest bracket of a wheelchair. The C shaped body is biased to a closed shape and can be easily manually operated to open the C shaped body and enable it to surround a foot rest bracket of a wheelchair. The contour of the protective cushion is designed to fit easily and comfortably about a wheelchair leg shaft, and the bracket blade and wheelchair post that typically form the foot rest bracket for supporting a wheelchair foot rest.

7 Claims, 7 Drawing Sheets

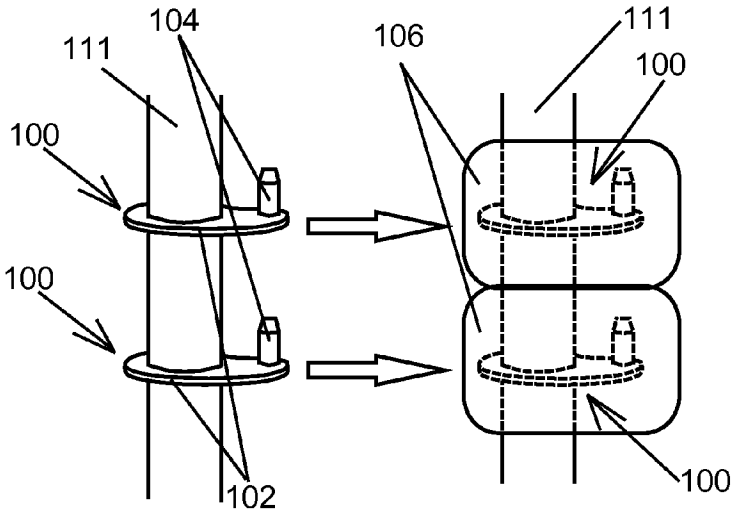
FIG. 6A FIG. 6B FIG. 6C FIG. 6D
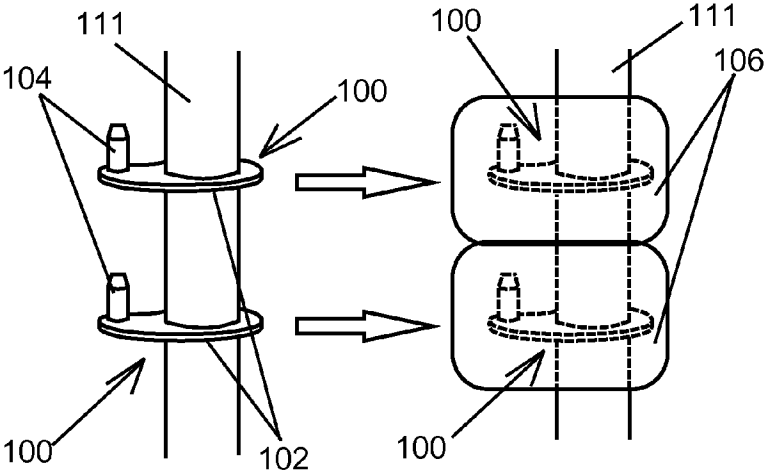

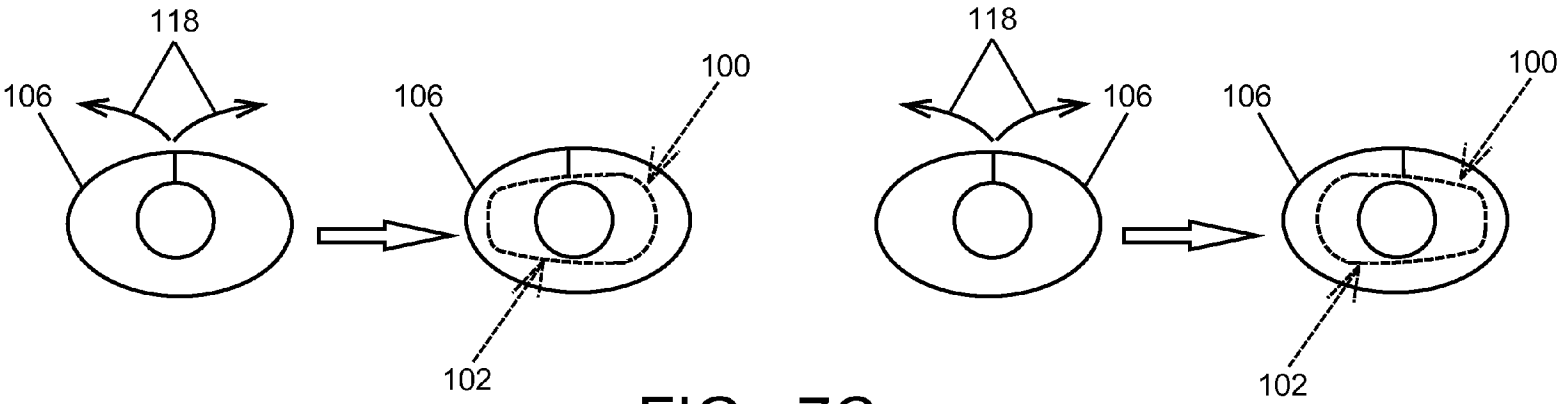
FIG. 7A
FIG. 7B
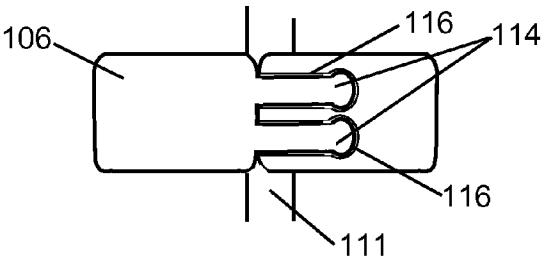
FIG. 7C

PROTECTIVE CUSHION FOR A WHEELCHAIR FOOT REST AND METHOD OF PROVIDING

RELATED APPLICATION/CLAIM OF PRIORITY

This application is related to and claims priority from provisional application Ser. No. 61/880,722, filed Sep. 19, 2013, and which provisional application is incorporated by reference herein.

BACKGROUND AND SUMMARY OF THE INVENTION

The present invention relates to a new and useful protective cushion for a foot rest bracket of a wheelchair and to a new and useful method of providing the protective cushion to a foot rest bracket of a wheelchair.

Most wheelchairs provide for removable attachment of footrests. The footrests are pivotally and removably fitted to the front legs of the wheelchair with the use of foot rest brackets. FIG. 2 is an illustration of a typical foot rest bracket for a wheelchair. The foot rest brackets are permanently attached to the front legs of the wheelchair above the front wheels. These foot rest brackets cause numerous injuries ranging from bruises and skin tears and severe lacerations that can take weeks to heal. Such injuries occur primarily during transfer of wheelchair patients with limited mobility, whether the patient is being assisted or getting out of the wheelchair on their own. FIG. 1 illustrates the manner in which a patient's leg can encounter a foot rest bracket in a manner that can cause the types of injuries described above.

While foot rest brackets on wheelchairs are inherently dangerous and continue to cause severe injuries, the solutions available in prior art for protectively covering these foot rest brackets are expensive and not practical for common use.

The present invention addresses these issues and provides a thick soft barrier from injury for patients that is a simple, convenient, inexpensive, practical, reusable device that can be applied or removed to the footrest bracket of a wheelchair in seconds, is preferably waterproof and easily wiped or washed clean and reapplied, that can be sized to fit foot rest brackets that are placed close to each other or inches apart, of various sizes and configurations and makes of wheelchair foot rest brackets.

According to the invention, a substantially monolithic body is provided that has a substantially closed C shape, a relatively soft, cushion like texture and a thickness that is slightly greater than a foot rest bracket of a wheelchair. The substantially monolithic C shaped body is biased to a closed C shape cushion and can be manually operated to open the C shaped body and enable the C shaped body to surround a foot rest bracket of a wheelchair. In order to apply the protective cushion to a wheelchair foot rest bracket, the C shaped body is manually opened and positioned about a foot rest bracket of a wheelchair. Then the C shaped body is released to enable the C shaped body to return under its bias to a substantially closed position in which the C shaped body substantially surrounds the foot rest bracket and provides a protective cushion for the foot rest bracket.

The contour of the protective cushion is designed to fit easily and comfortably about (a) a wheelchair leg shaft, and (b) the bracket blade and wheelchair post that typically form the foot rest bracket for supporting a wheelchair foot rest.

Further features of the present invention will become apparent from the following detailed description and the accompanying drawings.

BRIEF DESCRIPTION OF THE DRAWINGS

FIGS. 6 (A-D) schematically illustrate the manner in which a protective cushion is applied to a wheelchair leg rest bracket, according to the principles of the present invention; and FIGS. 7 (A-C) also schematically show the manner in which a protective cushion is applied to a wheelchair leg rest bracket, according to the principles of the present invention.

DETAILED DESCRIPTION

As discussed above, the present invention relates to a new and useful way of providing a cushion for a wheelchair foot rest bracket. The principles of the present invention are described in connection with a wheelchair foot rest bracket of the type shown in FIG. 1, and from that description, the manner in which the principles of the present invention can be used to provide a cushion for various types of wheelchair foot rest brackets will be apparent to those in the art.

Figure 1:
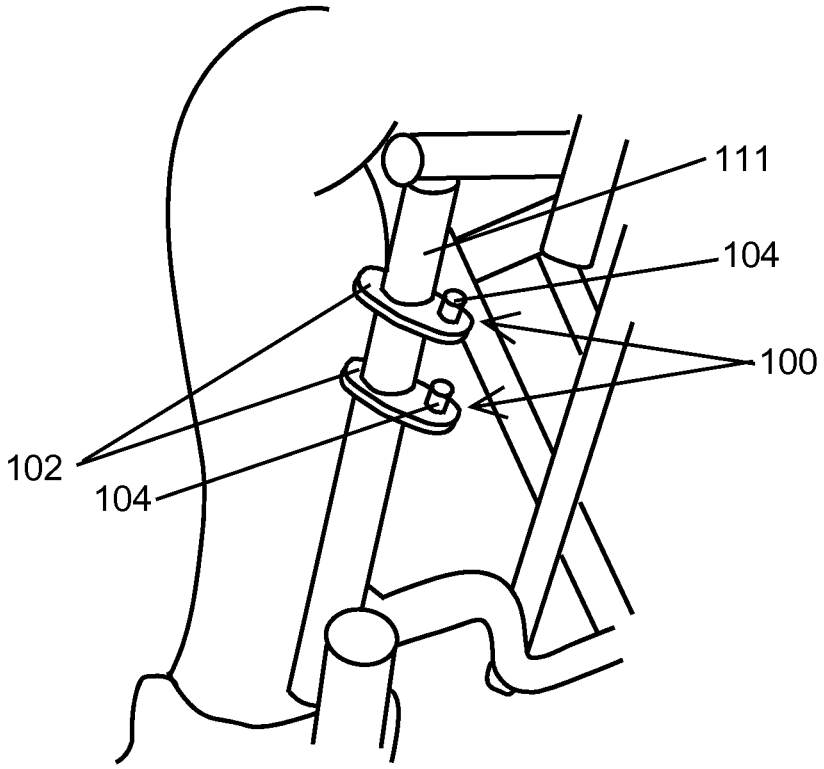
FIG. 1 is an illustration of a typical foot rest bracket of a wheelchair and shows how the leg of a patient can encounter a wheelchair foot rest bracket that is not protected by a protective cushion according to the present invention.

FIG. 1 is an illustration of a typical foot rest bracket 100 for a wheelchair (normally there are two foot rest brackets on each front leg of the wheelchair). The foot rest brackets 100 are permanently attached to the wheelchair shaft 111 above the front wheels. These foot rest brackets essentially comprise relative flat blades 102 and posts 104 that extend upward from the blades; the blades can cause numerous injuries ranging from bruises and skin tears to severe lacerations that can take weeks to heal. Such injuries occur primarily during transfer of wheelchair patients with limited mobility, whether the patient is being assisted or getting out of the wheelchair on their own. FIG. 1 illustrates the manner in which a patient's leg can encounter a foot rest bracket in a manner that can cause the types of injuries described above.

FIGS. 4, 5, 6A-6D, 7A-7C illustrate a protective cushion 106 and the manner in which the protective cushion is applied to the foot rest bracket 100 of a wheelchair, according to the principles of the present invention. As shown and described herein, the contour of the protective cushion is designed to fit easily and comfortably about (a) a wheelchair leg shaft 111, and (b) the bracket blade 102 and wheelchair post 104 that typically form the bracket for supporting a wheelchair foot rest.

Figure 2A:
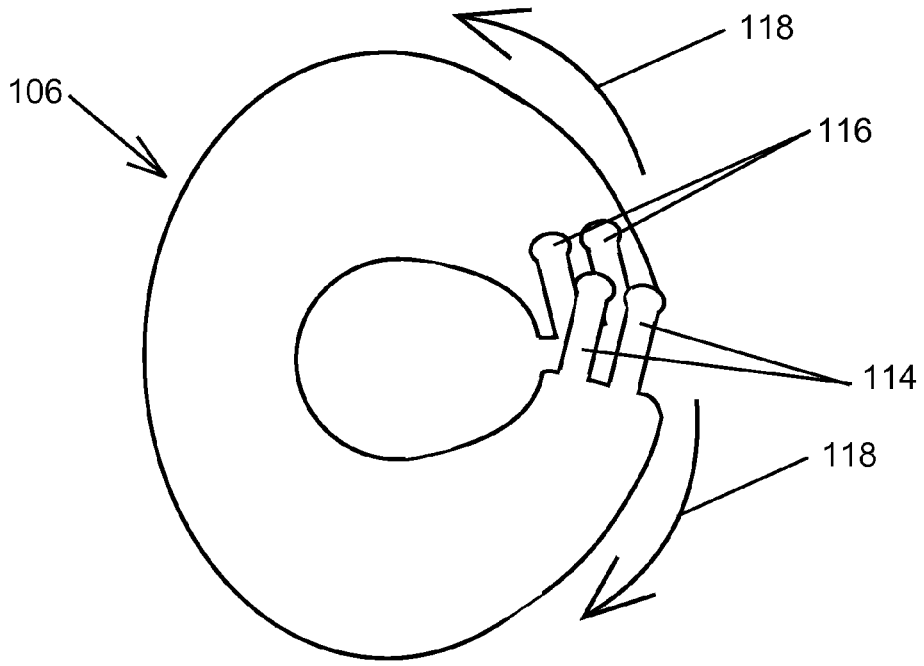
FIG. 2A is schematic illustration of a cushion for a wheel chair foot rest bracket, with the cushion shown in an open position.
Figure 2B:
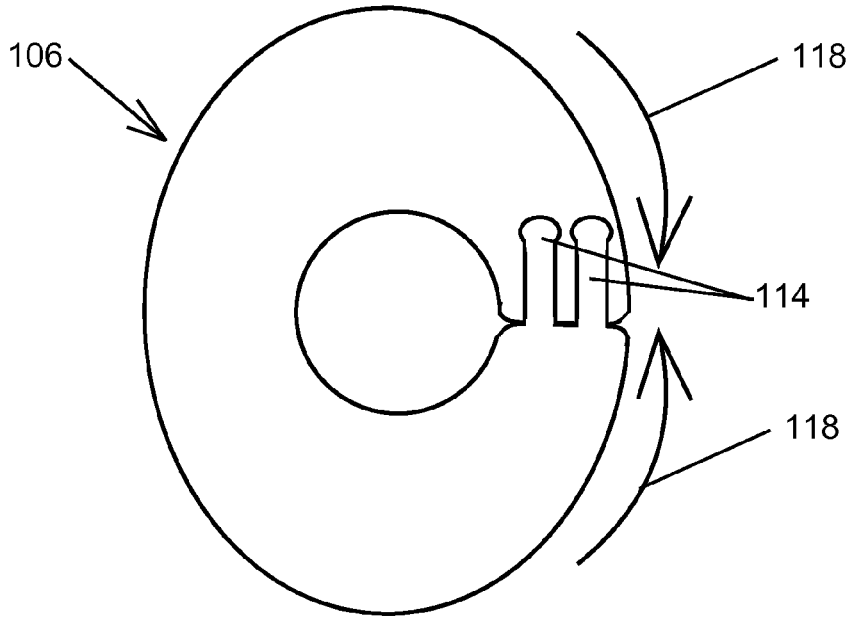
FIG. 2B is schematic illustration of a cushion for a wheel chair foot rest bracket according to the principles of the present invention, with the cushion shown in a closed position.
Figure 3:
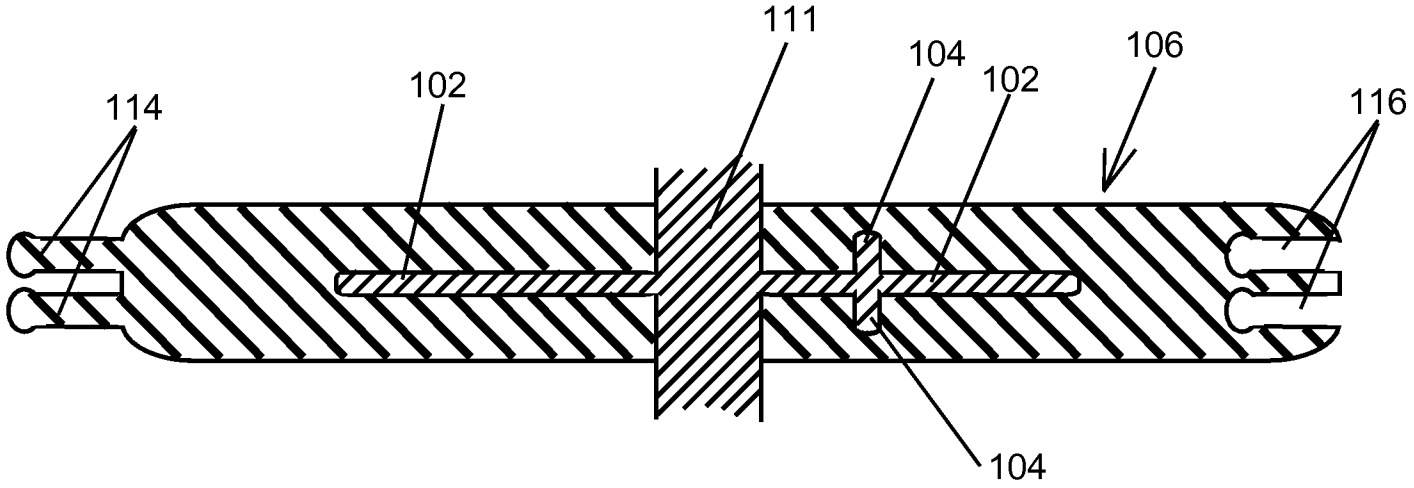
FIG. 3 is a schematic cross sectional illustration of the protective cushion for a wheelchair foot rest bracket, according to the invention, from the inside of the protective cushion, and with the protective cushion surrounding a wheelchair leg rest bracket.
Figure 5:
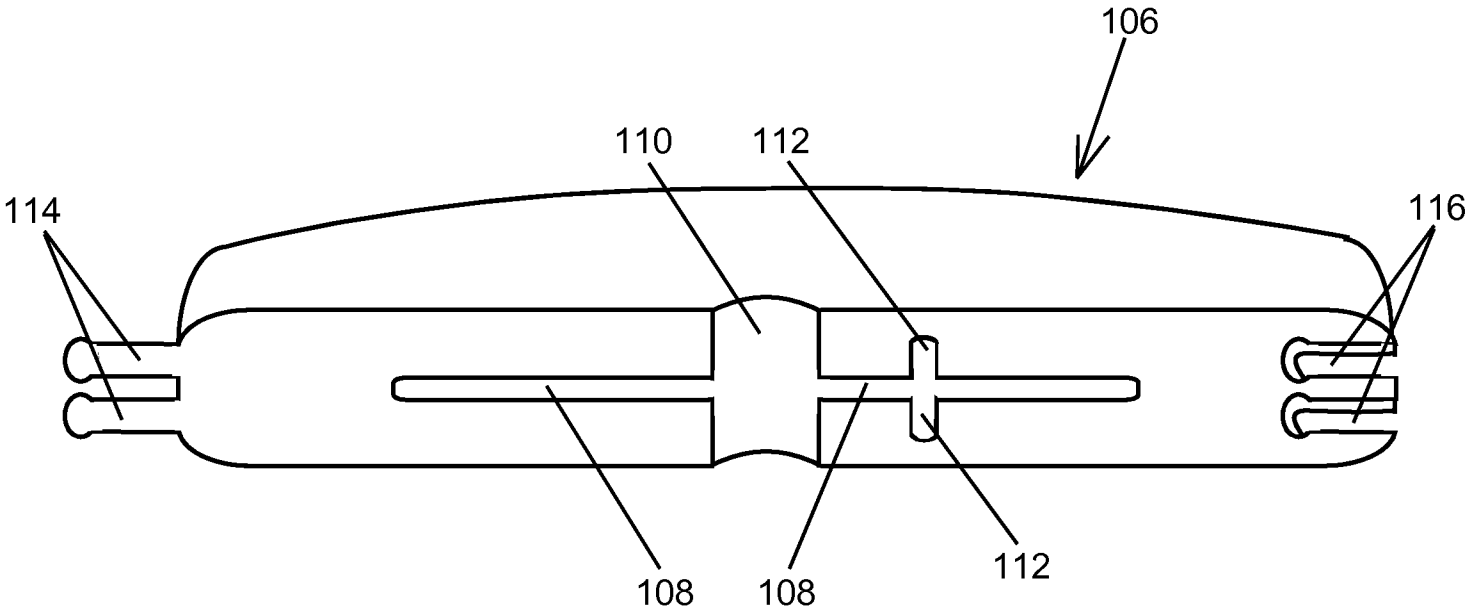
FIG. 5 is a schematic cutaway view of a protective cushion, according to the present invention, with a contour for surrounding (covering) a wheelchair leg rest bracket.

The protective cushion 106 comprises a substantially monolithic, nonmalleable, resilient body that has a substantially closed C shape (see FIG. 2B). The monolithic body can be formed in one piece, e.g. by molding or other type of forming technique, of an elastomeric (rubber like) material. The material has a relatively soft, cushion like texture and a thickness that is slightly greater than the vertical height of a wheelchair foot rest bracket. The substantially monolithic C shaped body is biased to a closed C shape cushion and can be manually operated to open the C shaped body and enable the C shaped body to surround a wheelchair foot rest bracket 100. FIGS. 2A and 5 show the protective cushion 106 in a partially opened position, to illustrate a slot 108 (referred to as a 'carveout for bracket blade") formed on the inside of the protective cushion 106. The slot 108 enables the protective cushion to fit comfortably about the blade 102 of a wheelchair foot rest bracket 100, as shown in FIG. 3 and described further below. In order to apply the protective cushion 106 to a wheelchair foot rest bracket 100, the C shaped body is manually opened and positioned about the wheelchair foot rest bracket 100. The slot 108 enables the protective cushion 106 to fit comfortably about the blade 102 of the wheelchair foot rest bracket, as described further below. Then the C shaped body is released to enable the monolithic, resilient C shaped body to return under its bias to a substantially closed position in which the C shaped body substantially surrounds the wheelchair foot rest bracket 100 and provides a protective cushion for the wheelchair foot rest bracket. FIG. 5 shows how the C shaped body encompasses the portion of the leg shaft 111, the blade 102 and post 104 that form the wheelchair foot rest bracket.

Figure 4:
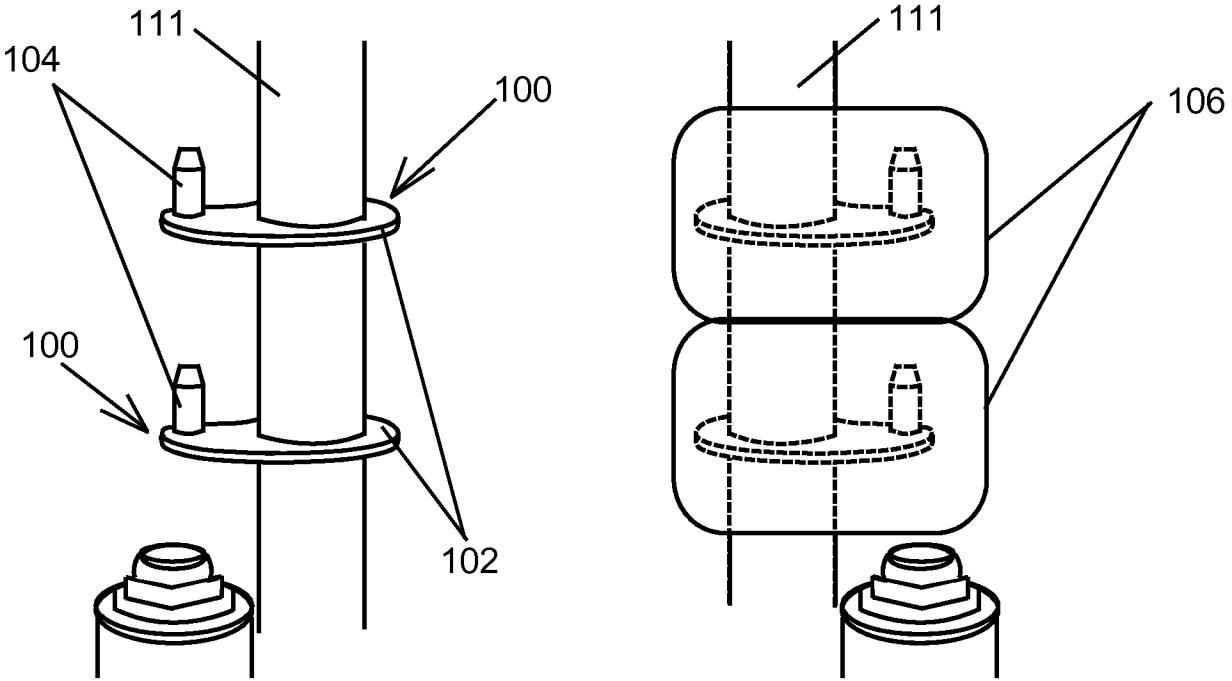
FIG. 4 is a schematic illustration of protective cushions applied to a pair of wheelchair foot rest brackets, according to the present invention.

FIG. 4 shows a pair of protective cushions 106, each of which fits around a respective wheelchair foot rest bracket 100, and provides a protective cushion for the wheelchair foot rest bracket. In FIG. 4, the leg rest brackets on the left side leg shaft are shown without the cushions, and the leg rest brackets on the right side are each encompassed by a protective cushion.

The present invention also provides the following additional features:

a. The protective cushion 106 is lightweight, easy to install, requires no maintenance, is easily cleaned, and is highly effective in preventing exposure to injuries to a patient's lower extremities when transferring into and out of a wheelchair.
b. The protective cushion 106 is specifically structured to contour easily around the wheelchair front leg foot rest bracket 100, as described further below.
c. The protective cushion 106 provides a thick compact protective cushion between wheelchair foot rest brackets on the front legs of a wheelchair, thereby preventing injury without in any way impeding motion of the patient when transferring in and out of the wheelchair.
d. The protective cushion 106 includes a relatively soft outer surface that will not damage a person's skin upon contact.
e. The protective cushion 106 is a monolithic, nonmalleable, resilient structure, preferably formed by single piece of molded material (e.g. elastomeric rubber like material) that can be cleaned by either hand washing or wiping and is then immediately available for reuse.
f. The protective cushion 106 is designed to be manufactured and massed produced so as to be sold at an affordable price.
g. As a feature of the monolithic nature of protective cushion 106, "settling" of contents within the structure will not be problematic as may occur in other devices, with the monolithic matrix maintaining a constant relationship between protective cushion 106 and the surfaces of the wheelchair foot rest bracket it is designed to envelop.
h. When not in use (i.e., when the wheelchair foot rests are attached to the wheelchair foot rest bracket), the protective cushions may be simply removed from the wheelchair leg rest brackets and displaced to a lower position on the wheelchair leg shaft, or on the shaft of the wheelchair foot rest itself for safe keeping until the wheelchair leg rests are again removed at which time the protective cushions are replaced on the wheelchair foot rest brackets, assuring that each wheelchair with its set of leg rests will have an easily available set of protective cushions for immediate application when they are needed.
i. Once designated to its given chair, protective cushion 106 need not be removed from said chair for cleaning, risking loss or unavailability for use, since protective cushion 106 may be cleaned while attached to said chair using the same high pressure/high temperature hose cleaning methods that are commonly used to clean said chair.

FIG. 5 is a schematic cutaway view of the interior and exterior of a protective cushion 106, according to the present invention, showing how the cushion is configured to surround a wheelchair leg rest bracket. As shown in that drawing, and also in FIG. 3 the protective cushion has a central opening 110 (called a "carveout") that surrounds a wheelchair leg shaft portion 111 of a wheelchair leg rest bracket, when the protective cushion is surrounding the wheelchair leg rest bracket. The monolithic protective cushion also has an internal configuration (with a paired portion 112 called a "carveout for wheelchair posts" and another portion 108 (described earlier as called a "carveout for bracket blade") that are shaped to accommodate the wheelchair bracket post 104, and the wheelchair leg rest bracket blade 102 respectively, when the protective cushion 106 is surrounding the wheelchair leg rest bracket. In addition, the monolithic protective cushion 106 has integrally formed interlocking digits 114 and mating recesses 116 that are configured to mate with each other to hold the protective cushion 106 in place about a wheelchair leg rest bracket.

FIGS. 2A, 2B, 6 (A-D) and FIGS. 7 (A-C) schematically illustrate the manner in which a protective cushion 106 is applied to a wheelchair leg rest bracket, according to the principles of the present invention. As shown in FIGS. 2B, 7A and 7C, the protective cushions 106 for the left and right side wheelchair leg rest brackets 100 are biased to their closed positions, and can be manually opened by manually pivoting them in the directions of the arrows 118 to the open position shown in FIG. 2A. They can then be placed about the wheelchair leg rest brackets, by inserting central opening 110 about the leg shaft portion 111, inserting the wheelchair bracket blades 102 into the carveouts 108, and maneuvering the protective cushion so that the carveouts 112 for the posts are applied about the posts of the wheelchair leg rest brackets. That results in the protective cushions 106 surrounding the wheelchair leg rest brackets in the manner illustrated from the side in FIGS. 6 (B, D) and from the top in FIGS. 7 (A, B). When a protective cushion 106 is properly positioned about a wheelchair bracket blades and posts, the protective cushion is allowed to close under its bias, in the direction shown by arrows 118 in FIG. 2B, and the interlocking digits 114 are inserted into the mating recesses 116 (FIGS. 2B and 7C), to maintain the protective cushion in place, until it is manually opened, to release it from the wheelchair leg rest bracket.

Thus, the foregoing description provides a way of providing a protective cushion for the foot rest bracket of a wheelchair, and from that description, the manner in which a protective cushion can be applied to various types of foot rest brackets for wheelchairs will be apparent to those in the art.

The invention claimed is:

1. A wheelchair footrest bracket with a protective cushion, wherein the wheelchair footrest bracket comprises a leg shaft portion, a wheel chair leg bracket blade extending transverse to the leg shaft portion, and a post extending upward from the bracket blade, wherein the protective cushion comprises a substantially monolithic body that has a substantially closed C shape, a relatively soft cushion like texture and a thickness that is slightly greater than a wheelchair foot rest bracket, wherein the protective cushion extends about the leg shaft portion, the bracket blade and the post of the footrest bracket.

2. The wheelchair foot bracket and protective cushion of claim 1, wherein the protective cushion has an internal contour designed to fit easily and comfortably about the portion of the wheelchair leg shaft, the bracket blade and wheelchair post.

3. A method of providing a protective cushion for a wheelchair foot rest bracket, comprising a. providing a substantially monolithic body that has a substantially closed C shape, a relatively soft, cushion like texture and a thickness that is slightly greater than a foot rest bracket of a wheelchair, the substantially monolithic C shaped body being biased to a closed C shape cushion and being manually operated to open the C shaped body and enable the C shaped body to surround a foot rest bracket of a wheelchair;

b. manually opening the C shaped body and positioning the separated C shaped body about a foot rest bracket of a wheelchair, and c. releasing the C shaped body to enable the C shaped body to return under its bias to a substantially closed position in which the C shaped body substantially surrounds the foot rest bracket and provides a protective cushion for the foot rest bracket.

4. The method of claim 3, wherein the substantially monolithic C shaped body is formed of material that is substantially waterproof and is easily cleaned.

5. The method of claim 3, wherein the substantially monolithic C shaped body has an internal slot that enables the body to fit comfortably about a flange of a wheelchair foot rest bracket.

6. The method of claim 5, wherein the wheelchair footrest bracket comprises a leg shaft portion, a wheel chair leg bracket blade extending transverse to the leg shaft portion, and a post extending upward from the bracket blade, and wherein the protective cushion extends about the leg shaft portion, the bracket blade and the post of the footrest bracket when the protective cushion is in its closed position and surrounds the wheelchair footrest bracket.

7. The method of claim 6, wherein the protective cushion has an internal contour designed to fit easily and comfortably about the portion of the wheelchair leg shaft, the bracket blade and wheelchair post when the protective cushion is in its closed position and surrounds the wheelchair footrest bracket.

* * * * *